United States Patent [19]

Rhodes

[11] Patent Number: 4,470,452

[45] Date of Patent: Sep. 11, 1984

[54] TURBULATOR RADIATOR TUBE AND RADIATOR CONSTRUCTION DERIVED THEREFROM

[75] Inventor: Eugene E. Rhodes, Belleville, Mich.

[73] Assignee: Ford Motor Company, Dearborn, Mich.

[21] Appl. No.: 396,981

[22] PCT Filed: May 19, 1982

[86] PCT No.: PCT/US82/00692

§ 371 Date: May 19, 1982

§ 102(e) Date: May 19, 1982

[87] PCT Pub. No.: WO83/04090

PCT Pub. Date: Nov. 24, 1983

[51] Int. Cl.[3] ..... F28F 3/08; F28D 1/02

[52] U.S. Cl. ..... 165/153; 165/167; 165/179

[58] Field of Search ..... 165/179, 151, 153, 167

[56] References Cited

U.S. PATENT DOCUMENTS

| | | | |
|---|---|---|---|
| 1,937,343 | 11/1933 | Higgins | 165/151 X |
| 2,017,201 | 10/1935 | Bossart et al. | 165/151 |
| 2,655,181 | 10/1953 | Cooper | 165/152 X |
| 4,081,025 | 3/1978 | Donaldson | 165/153 |

*Primary Examiner*—Douglas Hart

*Attorney, Agent, or Firm*—William E. Johnson; Olin B. Johnson

[57] ABSTRACT

This specification discloses an improvement to the construction of an elongated turbulator radiator tube (114) and a radiator construction produced thereby. In general, the turbulator radiator tube has a first principal heat transfer surface (120) and a second principal heat transfer surface (122), both of which have a first edge (124) and a second edge (126). Interconnecting surfaces (128) and (130) are provided for independently interconnecting both the first edges and the second edges of the first principal heat transfer surface and the second principal heat transfer surface. The improved construction is characterized in the following manner. Each of the principal heat transfer surfaces having a plurality of flow diverting members (152) placed along the length thereof. Each of the flow diverting members is deformed from the principal heat transfer surfaces toward the interior of the tube. The flow diverting members as a group extend from about the first edge of the principal heat transfer surface to about the second edge of the principal heat transfer surfaces. These flow diverting members are so arranged that the first principal heat transfer surface and the second principal heat transfer surface are bowed outwardly from the interior of the tube when interconnected by the interconnecting surfaces.

6 Claims, 7 Drawing Figures

TURBULATOR RADIATOR TUBE AND RADIATOR CONSTRUCTION DERIVED THEREFROM

TECHNICAL FIELD

This specification is directed to the construction of an elongated turbulator radiator tube which defines a fluid conduit through which a coolant may flow in order to have heat removed therefrom. The specification is also directed to a radiator construction made from such elongated turbulator radiator tubes.

BACKGROUND ART AND PRIOR ART STATEMENT

No search was conducted on the subject matter of this specification in the U.S. Patent and Trademark Office nor in any other search facility. The prior art which I consider to be most relevant is discussed in detail in the BEST MODE AND INDUSTRIAL APPLICABILITY section of this specification.

It is a principal object of this invention to provide a new construction for an elongated turbulator radiator tube which permits the tube to be assembled with other radiator forming components in a manner which provides better heat transfer characteristics from the radiator tube to other components of the radiator structure. This better heat transfer characteristic permits more rapid cooling of a coolant passing through the radiator tube and can reduce the size of radiator required in order to give a predetermined amount of cooling capacity.

DISCLOSURE OF THE INVENTION

This invention relates to an elongated turbulator radiator tube having an interior defining a fluid conduit and a radiator construction made using the elongated radiator tubes with other radiator forming components.

In its broadest form, the elongated turbulator radiator tube of this invention is one which has an interior defining a fluid conduit. The tube comprises a first principal heat transfer surface having a first edge and a second edge and a second principal heat transfer surface also having a first edge and a second edge. Surfaces independently interconnect both the first edges and the second edges of the first principal heat transfer surface and the second principal heat transfer surface.

The invention is characterized in the following manner. Each of the principal heat transfer surfaces have a plurality of flow diverting members placed along the length thereof. The flow diverting members are deformed from the principal surfaces toward the interior of the tube. The flow diverting members, as a group, extend from about the first edge of the principal heat transfer surfaces to about the second edge of said principal heat transfer surfaces. The flow diverting members are so arranged that the first principal heat transfer surface and the second principal heat transfer surface are bowed outwardly from the interior of the tube when interconnected by the interconnecting surfaces.

In a more preferred embodiment of the elongated turbulator radiator tube of this invention, each of the principal principal heat transfer surfaces are characterized in the following manner. Each of the principal heat transfer surfaces have a plurality of turbulator barriers placed along the length thereof. Each of the turbulator barriers are deformed from the principal surfaces toward the interior of the tube and extend from about the first edge of the principal heat transfer surfaces to about the second edge of the principal heat transfer surfaces. Each of the turbulator barriers are formed from two or more indentations. The principal heat transfer surfaces and the interconnecting surfaces are so constructed and arranged that the first principal heat transfer surface and the second principal heat transfer surface are bowed outwardly from the interior of the tube.

The shape of the deformations used to form the flow diverting members, which may take the form of a turbulator barrier as will be defined hereinafter, may come in a variety of configurations. However, the most preferred configuration is one in which each turbulator barrier is formed from a plurality of elongated, rectangular deformations which extend perpendicularly across each of the principal heat transfer surfaces from the first edge thereof to the second edge thereof. Also in accordance with the preferred embodiment, the turbulator barriers on the first principal heat transfer surface are in a staggered relationship with respect to the turbulator barriers formed on the second principal heat transfer surface.

Also in accordance with the teachings of this invention, a turbulator radiator construction is disclosed. In this construction at least a pair of coolant tanks are interconnected by a plurality of hollow turbulator radiator tubes through which the coolant may flow from one coolant tank to the other coolant tank. These hollow turbulator radiator tubes are made in accordance with the teachings of this specification regarding the elongated turbulator radiator tube construction. The radiator construction also includes corrugated heat transfer fins mounted between juxtaposed ones of the turbulator radiator tubes extending between the coolant tanks. This construction is characterized by using turbulator radiator tubes formed in accordance with the teachings of this specification.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of specific embodiments when read in connection with the accompanying drawings, wherein like reference characters indicate like parts throughout the several figures, and in which:

BEST MODE AND INDUSTRIAL APPLICABILITY

The following description is what I consider to be a preferred embodiment of an elongated turbulator radiator tube and radiator construction formed therefrom. The following description also sets forth what I now contemplate to be the best mode of manufacturing the elongated turbulator radiator tube and radiator construction formed therefrom. This description is not intended to be a limitation upon the broad principles taught herein and, while preferred materials are used to illustrate the construction in accordance with the requirements of the patent laws, it does not mean that other materials cannot be substituted therefor.

Figure 1:
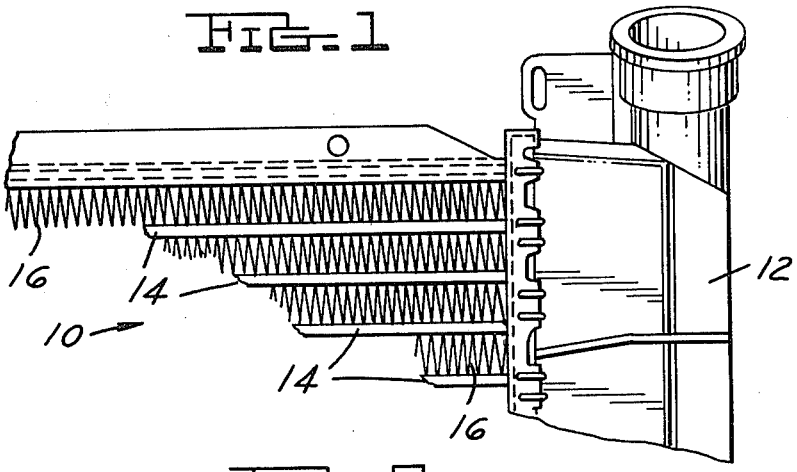
FIG. 1 is a partial elevation view of a radiator construction.

A radiator construction, generally identified by the numeral 10, as is shown in FIG. 1, is joined to a coolant tank 12 in a manner, for example, described in copending application Ser. No. 219,027 for a "Method of Joining an Object to an Article", filed Dec. 22, 1980, now abandoned, and assigned to the same assignee as this application.

In FIG. 1 there is seen only the right-hand coolant tank 12, but, of course, as is obvious to any skilled artisan, the radiator construction 10 would also have a left-hand coolant tank. In this manner coolant may be passed from a tank on one side of the radiator to a tank on the other side of the radiator through a plurality of hollow turbulator radiator tubes 14—14. Corrugated heat transfer fins 16—16 are mounted between juxtaposed of the turbulator radiator tubes extending between the coolant tanks. As the coolant flows through the turbulator radiator tubes, heat is given up from principal heat transfer surfaces thereof in contact with the heat transfer fins whereby the temperature of the coolant is reduced. The turbulator radiator tubes and heat transfer fins may be joined to one another in a fluxless aluminum brazing operation which is well known in the art.

Figure 2:
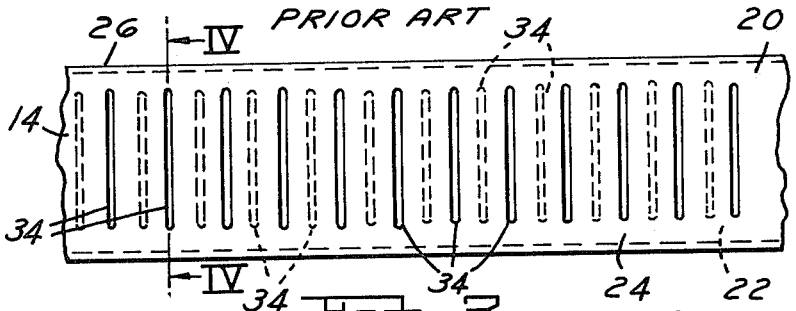
FIG. 2 PRIOR ART
FIG. 2 is a view showing a principal heat transfer surface of a turbulator radiator tube known in the prior art.
Figure 3:
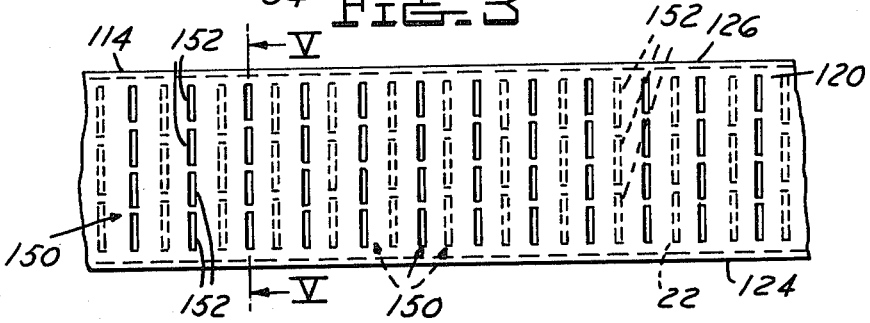
FIG. 3 is a view of a principal heat transfer surface of a turbulator radiator tube formed in accordance with the teachings of the preferred embodiment of this invention.
Figure 4:
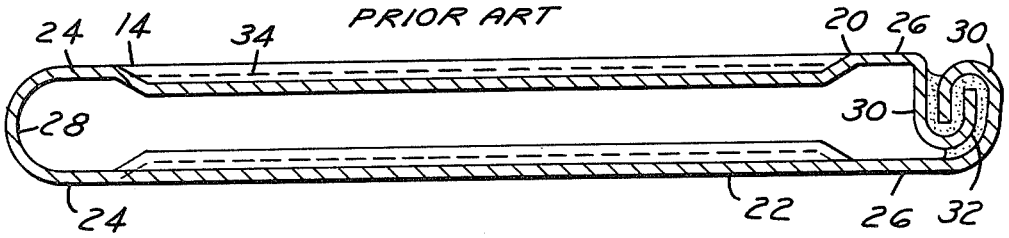
FIG. 4 PRIOR ART
FIG. 4 is an enlarged cross-sectional view taken along the line IV—IV of FIG. 2 showing in greater detail the prior art construction of a turbulator radiator tube.

In FIGS. 2 and 4 of the drawings there is shown a prior art construction for the turbulator radiator tubes 14. There is also shown, in FIGS. 3, 5, 6 and 7, the construction of a new turbulator radiator tube 114, in accordance with the teachings of this invention. The significant difference between the prior art construction 14 and the new construction 114 is that the new construction provides an improved physical contact between the turbulator radiator tube and its associated heat transfer fins. By use of this new construction, more heat may be extracted from a coolant flowing through the turbulator radiator tubes per unit volume of radiator construction 10. How this improved heat transfer contact is achieved will be explained in greater detail hereinbelow.

The turbulator radiator tube 14 of prior art construction is seen best in FIGS. 2 and 4. In this construction a first principal heat transfer surface 20 and a second principal heat transfer surface 22 are respectively facing and underneath the surfaces as shown in FIG. 2 and top and bottom surfaces as shown in FIG. 4. These surfaces define generally planar surfaces which when associated with heat transfer fins 16—16 provide the principal area of transferring heat from the turbulator radiator tubes to the heat transfer fins for dissipation to the atmosphere. Each of these principal heat transfer surfaces have a first edge 24 and a second edge 26. The edges are not sharply defined but generally are the areas at which the generally planar portions of the principal heat transfer surfaces come to an end.

As best seen in FIG. 4, the first edges 24—24 of the first principal heat transfer surface 20 and the second principal heat transfer surface 22 are interconnected by a generally continuous surface 28 which is integrally formed with the principal heat transfer surfaces. The second edges 26—26 of the first principal heat transfer surface and the second principal heat transfer surface are interconnected by interconnecting surfaces 30 which, in association with solder 32 used in conjunction therewith, form a sealed construction for the turbulator radiator tube 14. The method of forming and sealing such a turbulator radiator tube is well known in the industry and forms no part of this invention.

The prior art turbulator radiator tube 14 has a plurality of elongated turbulator elements 34 extending across the length thereof generally from the first edge 24 to the second edge 26 of each of the principal heat transfer surfaces 20 and 22. As is best seen in FIG. 2, these turbulator elements are staggered and are generally formed by deforming the material forming the turbulator radiator tubes toward the interior of the tube. Normally the material forming the tube is aluminum or some suitable aluminum alloy.

The difficulty with this type of construction for a turbulator radiator tube 14 is that the principal heat transfer surfaces 20 and 22 are relatively flat. The tube 14 is flexible in the sense that it may be twisted if opposite ends of the tube are gripped and rotated in opposite directions. However, when the tube is returned to its normal, flat condition the principal heat transfer surfaces 20 and 22 once again achieve the relatively flat condition. The difficulty with this condition is that when a plurality of such tubes and heat transfer fins are laid up for the purpose of assembly there is no flexibility in the turbulator radiator tubes to take up assembly tolerances. Therefore, while generally acceptable heat transfer contact is established between the heat transfer fins and the turbulator radiator tubes, the maximum heat transfer capability of the unit is not achieved because of the inflexibility of the turbulator radiator tubes to accommodate dimensional tolerance differences in the heat transfer fins. The heat transfer fins normally have a great deal of dimensional variation in the units because they are made from relatively thin materials and precise control of the dimensions of these fin units is extremely difficult, if not impossible. Thus, when the fins and the turbulator radiator tubes have pressure applied thereto to form them into a unit, any tolerances to be taken up are taken up almost totally by the heat transfer fins. This tolerance take-up causes many of the V-shaped contacting edges of the heat transfer fins to be crushed, away from a line contact with the turbulator radiator tube, thus reducing the heat transfer contact therebetween and, in many cases, causing spaces or slight voids between the heat transfer points.

The entire purpose of the structure of the turbulator radiator tube 114 of this invention is to provide flexibility not only in the heat transfer fin 16 but also in the turbulator radiator tube 114 so that both elements may be brought into the best physical contact to ensure the best heat transfer characteristics from the entire radiator construction 10. This will be better understood from the discussion set forth hereinbelow.

Figure 5:
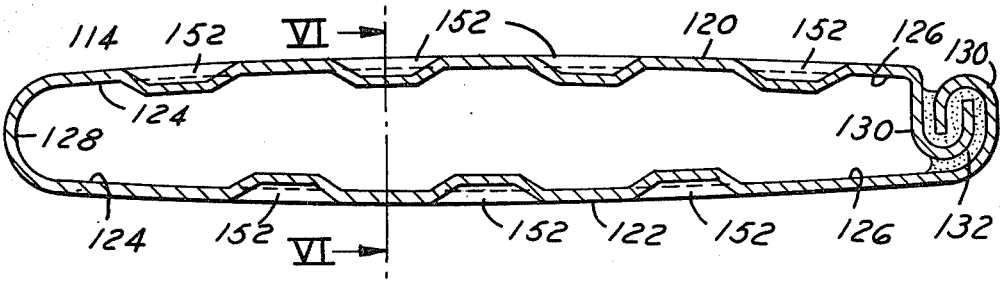
FIG. 5 is an enlarged cross-sectional view taken along the line V—V of FIG. 3 showing the details of the turbulator radiator tube construction in accordance with the preferred embodiment of this invention.
Figure 6:
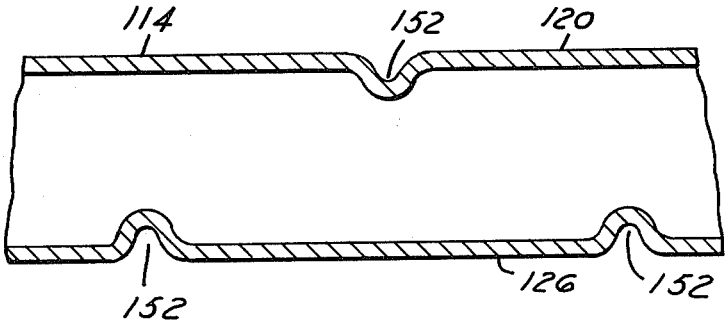
FIG. 6 is a view taken along the line VI—VI of FIG. 5 showing in greater detail the construction of the turbulator radiator tube in accordance with the preferred embodiment of this invention.

The turbulator radiator tube 114, as seen in FIGS. 3, 5 and 6, has a first principal heat transfer surface 120 and a second principal heat transfer surface 122. These principal heat transfer surfaces have first edges 124—124 and second edges 126—126 in juxtaposition to one another. Again, these edges are not sharply defined, but merely define a transition from the principal heat transfer surface to some type of an interconnecting surface. For example, in the case of the first edges 124—124, they are interconnected by a continuous surface 128 (FIG. 5) which is integrally formed with the entire structure. In the same manner, the second edges 126—126 and interconnected by interconnecting surfaces 130 and the solder 132 associated therewith.

In accordance with the teachings of a preferred embodiment of this invention, as is best seen in FIG. 3, turbulator barriers, generally identified by the numeral 150, are placed along the length of both the first principal heat transfer surface 120 and the second principal heat transfer surface 122. In accordance with the teachings of the preferred embodiment, the turbulator barriers are formed from two or more indentations 152—152. In the case of the preferred embodiment, the first principal heat transfer surface 120 has four indentations 152 to define the turbulator barrier 150, while the second principal heat transfer surface 122 has three indentations 152 to define the turbulator barrier 150. The turbulator barriers 150 formed on both the first and second principal heat transfer surfaces extend generally from the first edge 124 to the second edge 126 of each of the principal heat transfer surfaces.

The entire purpose for making the turbulator barriers 150 discontinuous across the principal heat transfer surfaces 120 and 122 is so that when the surfaces are being formed into the turbulator radiator tube 114 by soldering the interconnecting surfaces 130—130 the principal heat transfer surfaces may be bowed outwardly from the interior of the tube to give a slight crown to both of the principal heat transfer surfaces. This crowned effect may best be seen in FIG. 5. This slight crown is much different than the very flat surfaces achieved for the prior art turbulator radiator tube 14, as is seen in FIG. 4. The bowing or crowning of the turbulator radiator tube 114 permits it to also take up tolerances when it is brought into an assembled condition with a plurality of heat transfer fins 16 in order to form a radiator construction 10. The bowing or crowning of the principal heat transfer surfaces of the turbulator radiator tube 114 allows a flexing of that surface to take up tolerances when it is assembled with the heat transfer fins in an assembly opertion.

By being able to take up tolerances, the turbulator radiator tube 114 of this invention makes more intimate contact with associated heat transfer fins and thereby improves the unit heat transfer capability of each unit area of the radiator construction 10. This improved heat transfer efficiency allows for two options. A radiator construction of the same size using prior art turbulator radiator tubes 14 as compared with a radiator construction using turbulator radiator tubes 114 would result in dimensionally the same size radiator, but the construction made with the improved turbulator radiator tubes 114 would have the capacity for handling a greater cooling load. On the other hand, if one desired the radiator construction to have the same cooling capacity, then the radiator construction using the turbulator radiator tubes 114 of the present invention would require that the overall size of the radiator construction be reduced, that is, less fin and tube area would be required in order to do the same cooling job as would be accomplished by a larger size radiator containing the prior art type turbulator radiator tubes 14.

While the preferred type of turbulator barrier 150 has been illustrated in FIGS. 3, 5 and 6, many other types of barrier constructions may be used which still result in a turbulator radiator tube 114 which has a crowned construction and thus has the ability of taking up tolerances when assembled with heat transfer fins. It should be kept in mind that it is not necessary to space barriers on the first principal heat transfer surface and the second principal heat transfer surface in a staggered relationship, although this is preferred. The barriers may be placed one below the other. In this specification the term "turbulator barrier" is used to mean a series of indentations made in a principal heat transfer surface which may be generally aligned in some configuration. It is not necessary to achieve the benefits of this invention to have such a turbulator barrier as one may have a random placement of indentations in the principal heat transfer surfaces so long as the indentations are discontinuous thus allowing a bowing or crowning of the construction to achieve the advantages set forth above. However, once again, it is easiest to place a uniform set of indentations generally defining a turbulator barrier in a heat transfer surface than it is to place random indentations in such a surface.

Figure 7A:
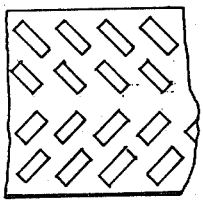
FIGS. 7A through 7G are other alternate embodiments of how a principal heat transfer surface of a turbulator radiator tube may be deformed in order to obtain the advantages of the turbulator radiator tube disclosed in this specification.
Figure 7B:
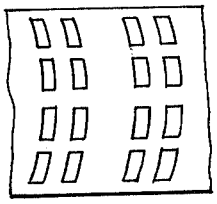
Figure 7C:
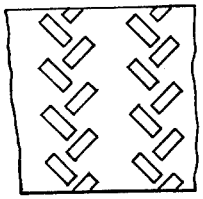
Figure 7D:
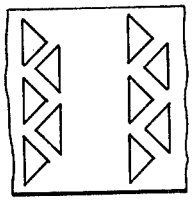
Figure 7E:
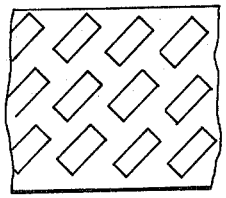
Figure 7F:
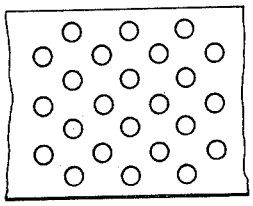
Figure 7G:
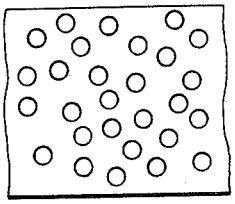

In FIGS. 7A through 7G a number of different patterns are shown which, if placed on the principal heat transfer surfaces, would produce the benefits of this invention. In FIG. 7A the individual indentations are formed into a turbulator barrier generally having an arrowhead shape. In FIG. 7B the indentations are placed to define a turbulator barrier having a generally curved configuration. In FIG. 7C the indentations are placed to define a turbulator barrier having a generally herringbone construction. In FIG. 7D the indentations are placed in the principal heat transfer surface in a manner which defines a turbulator barrier formed of a plurality of triangular members. In FIG. 7E the indentations are placed in the principal heat transfer surface in a manner which defines a turbulator barrier extending generally at an angle between the edges of the principal heat transfer surface. In FIG. 7F circular indentations are placed in the principal heat transfer surface generally in aligned position. In FIG. 7G the indentations are placed in the principal heat transfer surface generally in a random fashion and therefore do not define a turbulator barrier per se as no generally associated structure extends from one edge of the principal heat transfer surface to the other edge thereof.

While particular embodiments of the invention have been illustrated and described, it will be obvious to those skilled in the art that various changes and modifications may be made without departing from the invention and it is intended to cover in the appended claims all such modifications and equivalents as fall within the true spirit and scope of this invention.

I claim:

1. An elongated turbulator radiator tube having an interior defining a fluid conduit, which turbulator radiator tube comprises:

a first principal heat transfer surface having a first edge and a second edge;

a second principal heat transfer surface having a first edge and a second edge;

interconnecting surface means for independently interconnecting both said first edges and said second edges of said first principal heat transfer surface and said second principal heat transfer surface characterized by:

each of said principal heat transfer surfaces having a plurality of flow diverting members placed along the length thereof, each of the flow diverting members being deformed from said principal surfaces toward said interior of said tube, said flow diverting members as a group extending from about said first edge of said principal heat transfer surfaces to about said second edge of said principal heat transfer surfaces, said flow diverting members being so arranged that said first principal heat transfer surface and said second principal heat transfer surface are bowed outwardly from said interior of said tube when interconnected by said interconnecting means.

2. An elongated turbulator radiator tube having an interior defining a fluid conduit, which turbulator radiator tube comprises:

a first principal heat transfer surface having a first edge and a second edge;

a second principal heat transfer surface having a first edge and a second edge;

interconnecting surface means for independently interconnecting both said first edges and said second edges of said first principal heat transfer surface and said second principal heat transfer surface characterized by:

each of said principal heat transfer surfaces having a plurality of turbulator barriers placed along the length thereof, each of the said turbulator barriers being deformed from said principal surfaces toward said interior of said tube and extending from about said first edge of said principal heat transfer surfaces to about said second edge of said principal heat transfer surfaces, each of said turbulator barriers being formed from two or more indentations;

said principal heat transfer surfaces and interconnecting surface means being so constructed and arranged that said first principal heat transfer surface and said second principal heat transfer surface are bowed outwardly from said interior of said tube.

3. The elongated turbulator radiator tube of claim 2, in which said turbulator barriers are in the form of a plurality of rectangular deformations extending generally perpendicularly across said principal heat transfer surfaces from said first edge thereof to said second edge thereof.

4. The elongated turbulator radiator tube of claim 2, in which said turbulator barriers are in the form of a plurality of rectangular deformations extending generally perpendicularly across said principal heat transfer surfaces from said first edge thereof to said second edge thereof and wherein said turbulator barriers on each of said principal heat transfer surfaces are offset from one another so that they are in a staggered relationship.

5. A radiator construction in which a pair of coolant tanks are interconnected by a plurality of hollow turbulator radiator tubes through which coolant may flow from one conduit tank to the other coolant tank and wherein corrugated heat transfer fins are mounted between juxtaposed ones of said turbulator radiator tubes extending between said coolant tanks, an improved construction for said turbulator radiator tubes which comprises:

a first principal heat transfer surface having a first edge and a second edge;

a second principal heat transfer surface having a first edge and a second edge;

interconnecting surface means for independently interconnecting both said first edges and said second edges of said first principal heat transfer surface and said second principal heat transfer surface characterized by:

each of said principal heat transfer surfaces having a plurality of flow diverting members placed along the length thereof, each of the flow diverting members being deformed from said principal surfaces toward said interior of said tube, said flow diverting members as a group extending from about said first edge of said principal heat transfer surfaces to about said second edge of said principal heat transfer surfaces, said flow diverting members being so arranged that said first principal heat transfer surface and said second principal heat transfer surface are bowed outwardly from said interior of said tube when interconnected by said interconnecting surface means.

6. A radiator construction in which a pair of coolant tanks are interconnected by a plurality of hollow turbulator radiator tubes through which coolant may flow from one conduit tank to the other coolant tank and wherein corrugated heat transfer fins are mounted between juxtaposed ones of said turbulator radiator tubes extending between said coolant tanks, an improved construction for said turbulator radiator tanks which comprises:

a first principal heat transfer surface having a first edge and a second edge;

a second principal heat transfer surface having a first edge and a second edge;

interconnecting surface means for independently interconnecting both said first edges and said second edges of said first principal heat transfer surface and said second principal heat transfer surface characterized by:

each of said principal heat transfer surfaces having a plurality of turbulator barriers placed along the length thereof, each of the turbulator barriers being deformed from said principal surfaces toward said interior of said tube and extending from about said first edge of said principal heat transfer surfaces to about said second edge of said principal heat transfer surfaces, each of said turbulator barriers being formed from two or more indentations;

said principal heat transfer surfaces and said interconnecting surface means being so constructed and arranged that said first principal heat transfer surface and said second principal heat transfer surface are bowed outwardly from said interior of said tube.

* * * * *